United States Patent [19]

Boland

[11] 4,274,335

[45] Jun. 23, 1981

[54] MONORAIL POLICE PATROL VEHICLE

[76] Inventor: Roy Boland, P.O. Box 304, Claymont, Del. 19703

[21] Appl. No.: 72,645

[22] Filed: Sep. 5, 1979

Related U.S. Application Data

[63] Continuation-in-part of Ser. No. 827,983, Aug. 26, 1977, abandoned.

[51] Int. Cl.[3] ..... B61B 3/02

[52] U.S. Cl. ..... 104/93; 104/89; 104/122; 105/148; 105/150; 105/153

[58] Field of Search ..... 104/89, 91, 93, 122, 104/127, 128, 129; 105/148, 150, 153; 212/266; 89/40 B

[56] References Cited

U.S. PATENT DOCUMENTS

| | | | |
|---|---|---|---|
| 904,525 | 11/1908 | Frederick | 105/148 X |
| 3,125,964 | 3/1964 | Silverman | 104/89 |
| 3,353,503 | 11/1967 | Pettit | 105/150 |
| 3,457,876 | 7/1969 | Holden | 104/122 X |
| 3,605,935 | 9/1971 | Gilbert | 104/122 X |
| 3,626,856 | 12/1971 | Goodell | 104/89 |
| 3,790,001 | 2/1974 | Schnell | 105/148 X |
| 3,828,939 | 8/1974 | Tranchero . | |
| 3,938,670 | 2/1976 | Wellman . | |
| 3,977,548 | 8/1976 | McCannon et al. . | |

FOREIGN PATENT DOCUMENTS

| | | | |
|---|---|---|---|
| 2541097 | 3/1977 | Fed. Rep. of Germany | 104/122 |

OTHER PUBLICATIONS

"The Secret of the 'Baby' Tank", *Scientific American* (vol. CXIX, No. 22) Nov. 30, 1918.

*Primary Examiner*—Randolph A. Reese
*Attorney, Agent, or Firm*—Howson and Howson

[57] ABSTRACT

A monorail type vehicle which is particularly suited for high speed travel on a street or at various locations above a street. The vehicle comprises a motor driven tandem wheel carriage engaging an overhead monorail and a gondola suspended from the carriage by means of an elongated boom having one end pivotally and hydraulically connected to the carriage and having a free end mounting a series of hydraulic cylinders and links operatively connected to the rear of the gondola for raising and lowering the gondola as desired.

6 Claims, 7 Drawing Figures

MONORAIL POLICE PATROL VEHICLE

CROSS-REFERENCE TO RELATED APPLICATION

The present application is a continuation-in-part of application Ser. No. 827,983 filed on Aug. 26, 1977, now abandoned.

FIELD OF THE INVENTION

The present invention relates to monorail-type passenger vehicles, and more particularly, the present invention relates to monorail type vehicles having some means for raising and lowering the vehicle from an elevated position adjacent the underside of a monorail to a lowered position at street level. The present invention is particularly suited for police patrol work in large metropolitan cities or alternatively as public transport conveyances in rapid transit systems.

BACKGROUND OF THE INVENTION

It is known that in densely-populated cities, such as Philadelphia, New York, Chicago, etc. police patrols using automobiles is of limited effectiveness because of the tendency for patrol cars to become bogged-down in traffic, thereby being unable to respond promptly to emergency situations. It should be apparent, therefore, that an emergency type vehicle which can carry passengers in an elevated position along the underside of the monorail located above a city street, or along a street surface, is particularly suited for police work. This is because, in its elevated position, the vehicle can travel at high rates of speed above the traffic and is, therefore, able to cover substantial distances in short periods of time. When the vehicle arrives at its intended location, it can be lowered to street level, either for riding along the street, or for stopping to load or unload passengers. Needless to say, such a vehicle used in densely populated metropolitan areas would increase police effectiveness with less manpower. Preferably, such a vehicle, if used for police patrol work, should be highly maneuverable and lightly armored for protection of the police and have as standard equipment a rotatable turret for observation and/or for use of fire arms, if necessary.

Such a vehicle as described above must be capable of accelerating and decelerating rapidly. Since acceleration and deceleration forces can create substantial stresses on various parts of the vehicle, the vehicle of the above type must be capable of withstanding such stresses in order to insure the safety of the passengers. Moreover, the vehicle must be capable of being raised and lowered rapidly, even while in motion.

OBJECTS OF THE INVENTION

With the foregoing in mind, it is a principal object of the present invention to provide a new and improved overhead monorail vehicle having a gondola which may be raised and lowered.

It is another object of the present invention to provide simple yet reliable means for raising and lowering a gondola between a retracted position adjacent the underside of the monorail and an extended position adjacent street level.

A further object of the present invention is to provide a new and improved rail and drive wheel design for a monorail type vehicle to insure that the vehicle does not derail at operating speeds.

A further object of the present invention is to provide a monorail type vehicle which is specifically designed for police patrol work in congested areas of large cities.

Yet another object of the present invention is to provide apparatus which provides an efficient and economical means of affording police protection and patrol in large cities.

A still further object of the present invention is to provide a means for increasing the police coverage in high crime areas of large cities without necessitating an increase in police manpower.

SUMMARY OF THE INVENTION

As a more specific object, the present invention provides apparatus for transporting people rapidly either along a ground surface or in an elevated position adjacent the underside of a monorail, or at various intermediate levels. The apparatus includes a monorail, motorized carriage mounted on the monorail, a gondola disposed below the monorail carriage, and means connecting the gondola and the carriage to raise and lower the gondola relative to the carriage even while the carriage is in motion. The raising and lowering means includes an elongated fixed-length boom which is pivotally connected at one end to the carriage and which has a free end mounting a series of links and hydraulic cylinders which are connected to the aft end of the gondola. A main hydraulic cylinder connects the boom to the carriage and pivots the boom from a retracted position extending along the underside of the carriage to an extended position depending substantially vertically downward therefrom. Control means in the gondola causes the main hydraulic cylinder to cooperate with the links and other hydraulic cylinders for raising and lowering the gondola. Cooperating hooks are mounted atop the gondola and to the boom for interengaging one another when the boom is in its uppermost position and the gondola is fully retracted.

BRIEF DESCRIPTION OF THE DRAWINGS

The foregoing and other objects, features and advantages of the present invention should become apparent from the following description when taken in conjunction with the accompanying drawings, in which.

DESCRIPTION OF THE PREFERRED EMBODIMENT

Figure 1:
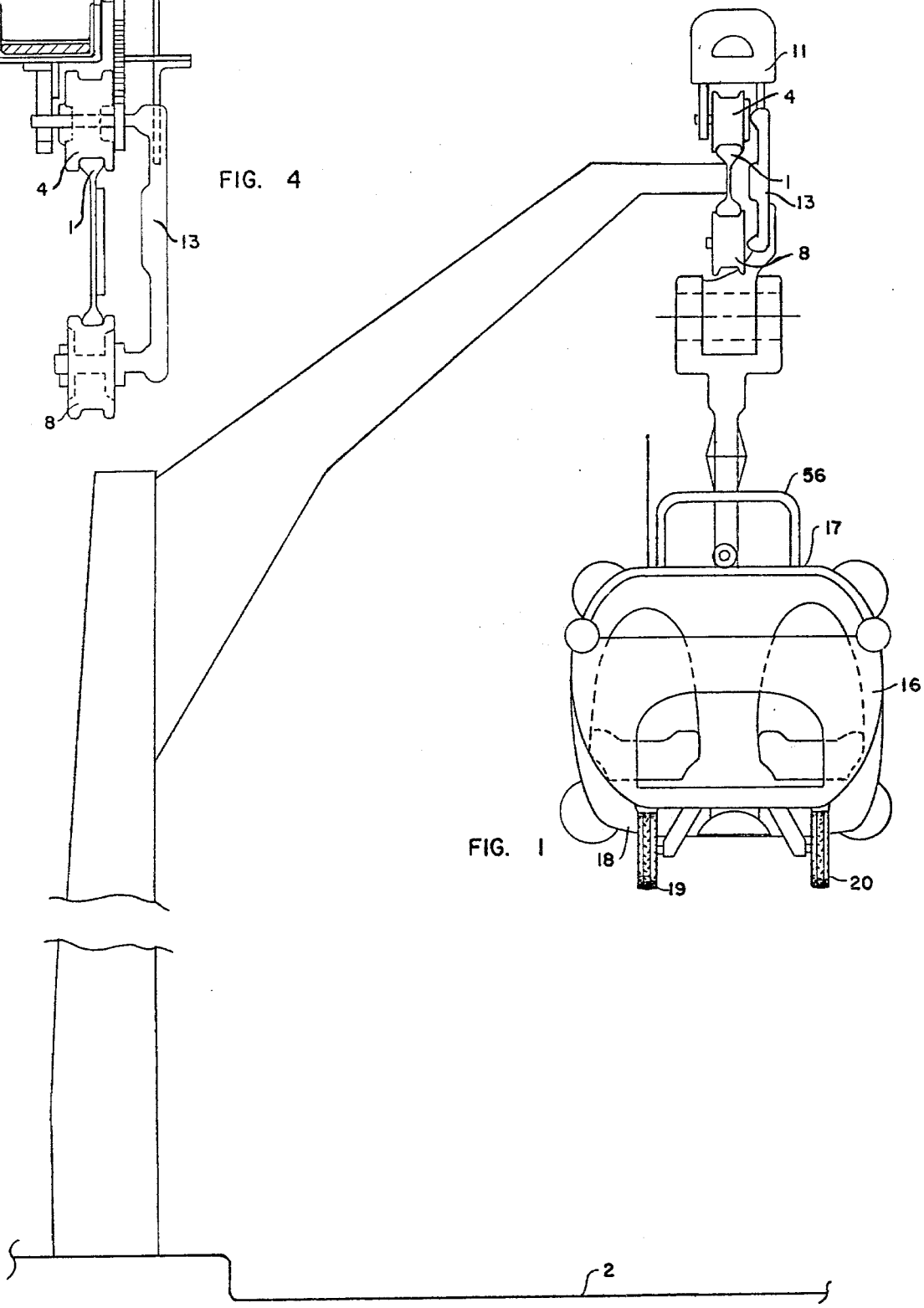
FIG. 1 is a front elevational view of a monorail vehicle embodying the present invention, the view illustrating the vehicle in its retracted position.
Figure 2:
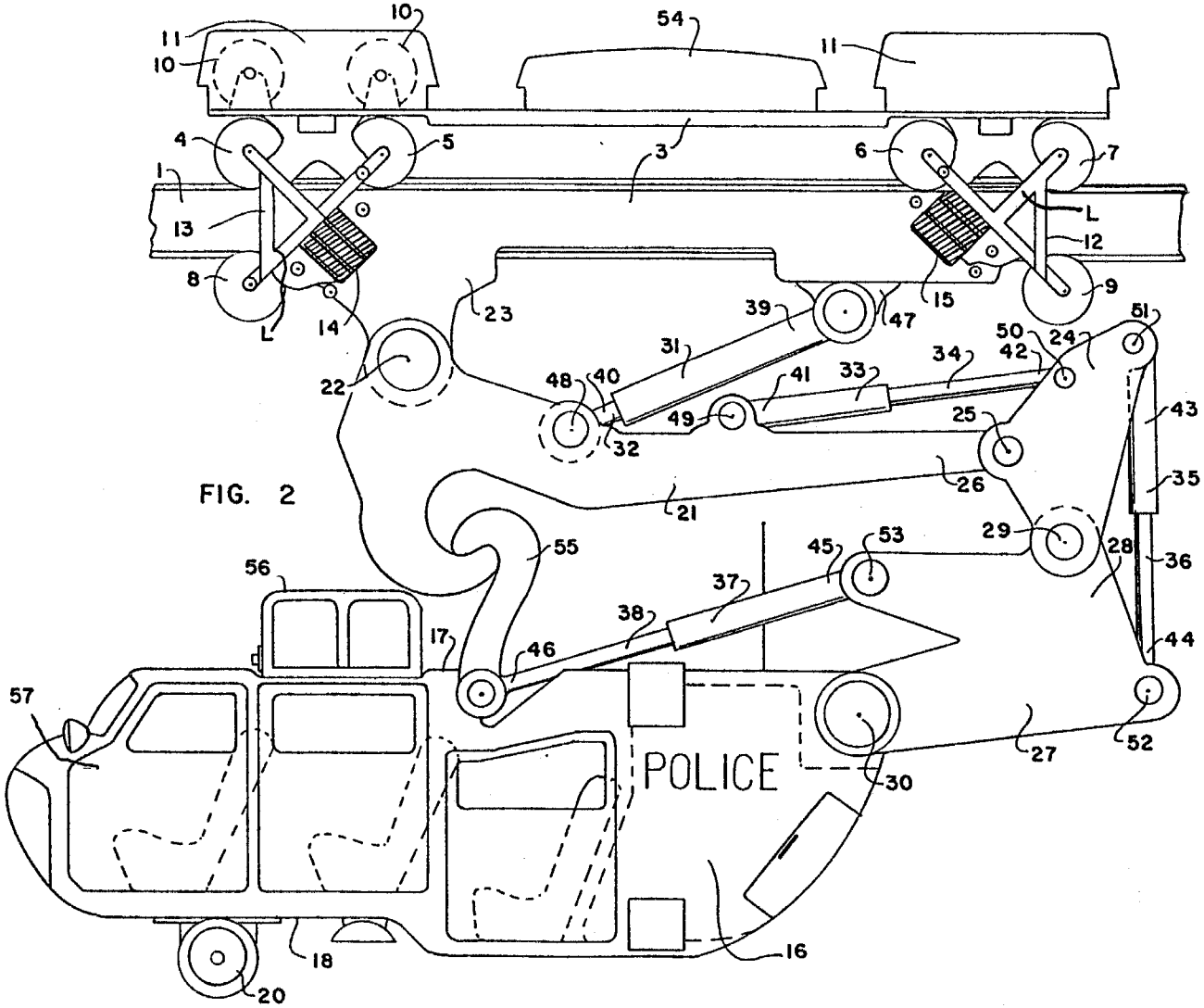
FIG. 2 is a side elevational view of the vehicle illustrated in FIG. 1, but not illustrating monorail support stanchions.
Figures 3, 5:
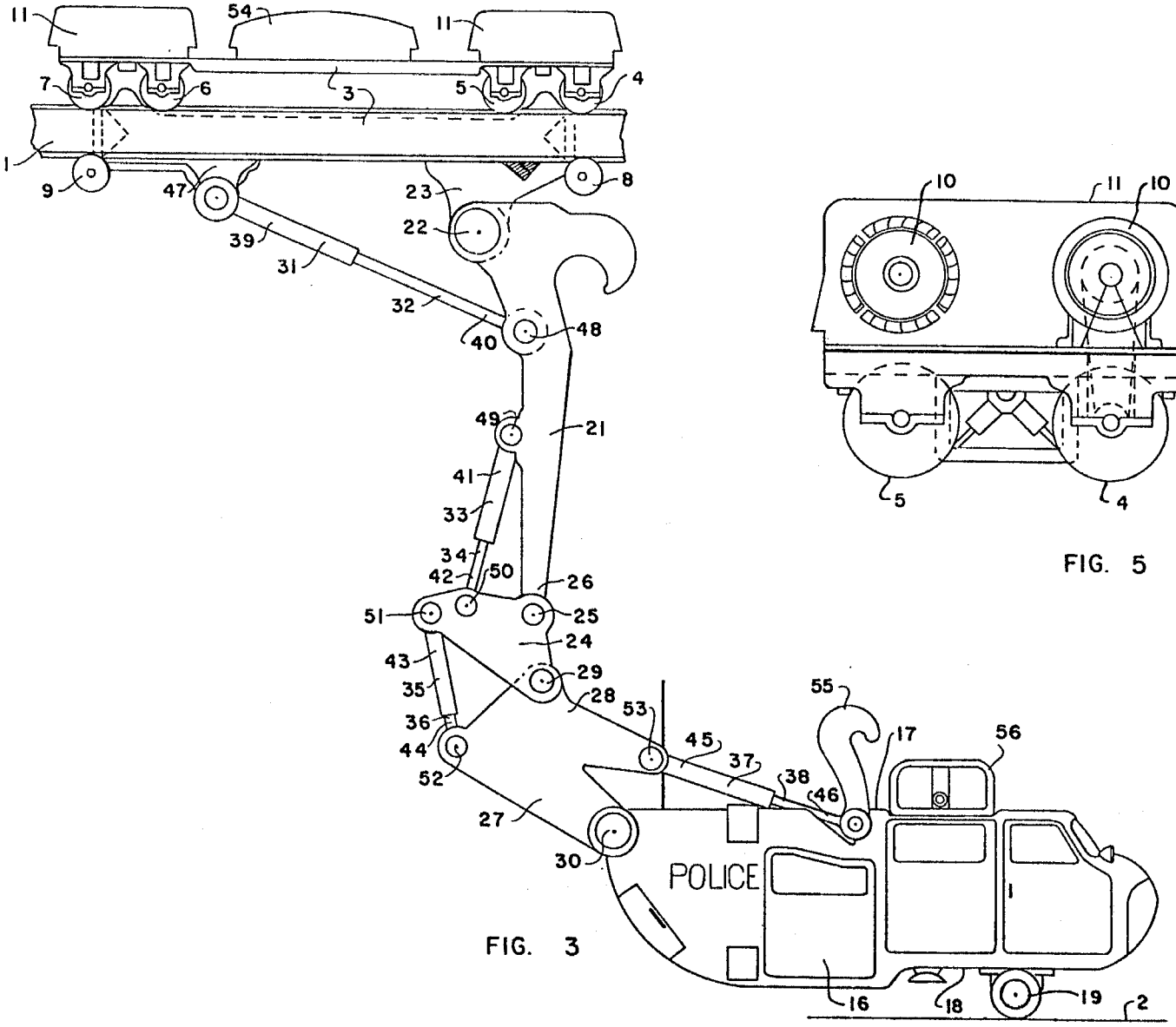
FIG. 3 is a side view, in reduced scale, of the vehicle illustrated in FIG. 2, but illustrating the gondola in its lowermost extended position at street level.
FIG. 5 is an enlarged sectional view of one of the pair of motor drive-transmission units of the carriage illustrated in FIG. 3.

Referring now to FIGS. 1–3, it may be seen that the present invention provides a monorail type vehicle which is designed to run along a horizontally disposed track 1 connected at spaced intervals to a series of arms which extend outwardly and upwardly from stanchions such as illustrated in FIG. 1. The rail or track 1 supports a carriage from which a gondola 16 is suspended. In the illustrated embodiment, the carriage comprises a chassis 3 and axle frames 12 and 13 which ride on shock absorbing devices 14 and 15. The axle frames and the chassis are connected by means of linkages L (FIG. 2), and a plurality of grooved wheels 4, 5, 6, 7, 8 and 9 (FIG. 2) mount the carriage to the rail 1.

Figure 4:
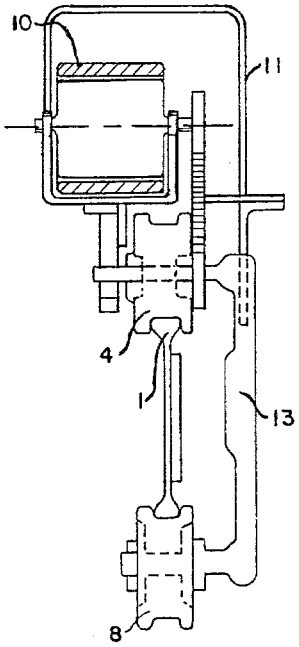
FIG. 4 is a partially-sectioned, enlarged front view of the carriage portion of the vehicle illustrated in FIG. 1.

Motive power for the carriage is provided by specially-designed electric motors 10 which are mounted to the chassis 3 and connected to the wheels 4–7 via suitable drive mechanisms such as illustrated in FIGS. 4 and 5. Preferably, all motors are driven simultaneously to accelerate the carriage along the track 1 and, as the carriage speed increases, selective motors are shunted out by means of suitable controls contained in motor control center 54 mounted atop the chassis 3. At cruising speed, the monorail vehicle is thereby capable of operating with a minimum of power input.

The rail 1 is provided with a special shape for mating with the grooved wheels 4–7 to support the carriage on the rail 1. Wheels 8 and 9 engage the underside of the rail 1 and act as guides to prevent derailment of the carriage at designed speeds of the vehicle. As may be seen in FIGS. 2 and 4, the axle support members 12 and 13, and the carriage chassis 3, overhang one side of the rail 1. Preferably, the rail 1 is fabricated by rolling it into the illustrated "I" shape. Thus, the bottom and top grooved wheels grip the rail 1 and cooperate to absorb lateral movement to eliminate the need for special appurtenances which otherwise would be required for this purpose.

As best seen in FIG. 2, the gondola 16 has a fuselage shape with an observation dome or turret 56 which is mounted adjacent its upper forward end and which may be provided with gun ports if the vehicle is used for police patrol work. Preferably, the gondola 16 mounts a series of seats enabling it to carry a series of passengers. At the lower forward end of the gondola 16, wheels 19 and 20 are provided to allow the gondola to be driven along a street surface directly under the rail 1 either intentionally or in the event of a failure of the hydraulic system. As will be discussed, a latching mechanism 55 is provided to mechanically interconnect the gondola 16 to the boom 21 when the gondola 16 is in its uppermost elevated position.

For the purpose of raising and lowering the gondola 16 relative to the carriage, a series of hydraulic cylinders and links are provided to form an articulated connection therebetween. To this end, the forward end of the chassis 3 has a depending appendage 23 which pivotally mounts the forward end 22 of a first elongated member or boom 21. The boom 21 is of a predetermined fixed length and extends rearwardly from the appendage 23 along the underside of the chassis 3 substantially parallel to the rail 1 when the gondola 16 is in its uppermost position as illustrated in FIG. 2. The boom 21 is pivoted in a clockwise direction about its pivot point 22 by means of a hydraulic cylinder and piston assembly 31,32. The upper or rear end 39 of the cylinder 31 is pivotally connected to an appendage 47 at the bottom rear of the chassis 3, and the second or lower terminal end 40 of the piston 32 is pivotally connected to the boom 21 by a bearing 48 located adjacent the pivotal connection 22 of the front end of the boom 21 to the chassis appendage 23. Thus, extension and retraction of the piston 32 in a well known manner causes the boom 21 to pivot either clockwise or counterclockwise about its pivot point 22 in a manner to be described.

The rear or second end 26 of the boom 21 pivotally mounts a generally triangular shaped second link member 24 to pivot about a bearing 25 located at a first vertex thereof. A generally rectangular shaped third link member 27 is pivotally secured adjacent its upper rear end corner 28 to a third vertex bearing 29 located below and rearwardly of the vertex 25 at the free end 26 of the boom 21. A second end 30 of the rectangular member 27, located diagonally-opposite the end 29, is pivotally connected to the upper rear end of the gondola 16.

The link members 24 and 27 are pivoted relative to one another and the gondola 16 as the boom 21 pivots from its retracted position illustrated in FIG. 2 to its extended position illustrated in FIG. 3. To this end, a series of second, third and fourth hydraulic cylinder and piston sets 33, 34; 35, 36; and 37, 38, respectively, are provided. Each of the cylinder and piston sets have spaced opposite first and second ends such as the ends 41 and 42; 43 and 44; and 45 and 46, respectively, the first end being at the mounted end of the cylinder and the second end being at the free end of the piston.

In order to pivot the link 24, the first end 41 of the second hydraulic cylinder set 33, 34 is pivotally affixed to the boom 21 at a second point 49 which is located intermediate the first bearing point 48 where the main cylinder piston 40 is connected and the second or free end 26 of the boom 21. The second end 42 of the second cylinder and piston set 33, 34 is pivotally secured to a point 50 of the triangular link member 24 intermediate the vertices 25 and 51 thereof.

The first end 43 of the third piston and cylinder set 35, 36 is pivotally secured to the third vertex 51 of the second traingular link or support member 24 rearwardly of the free end of the boom 21. The second end 44 of the third piston and cylinder set 35, 36 is pivotally secured to a second corner 52 of the third support or link member 27. The first end 45 of the fourth piston and cylinder set 37, 38 is pivotally secured to a third corner 53 of the third support or link member 27. The second end 46 of the fourth piston and cylinder set 37, 38 is pivotally secured to the top 17 of the gondola 16 adjacent its midsection.

A control console 57 is located in the front of the gondola 16 and is provided for the purpose of actuating the various piston and cylinder sets for operating the motors 10 to drive the carriage along the rail and to raise and lower the gondola 16 relative to the rail 1.

Figure 6:
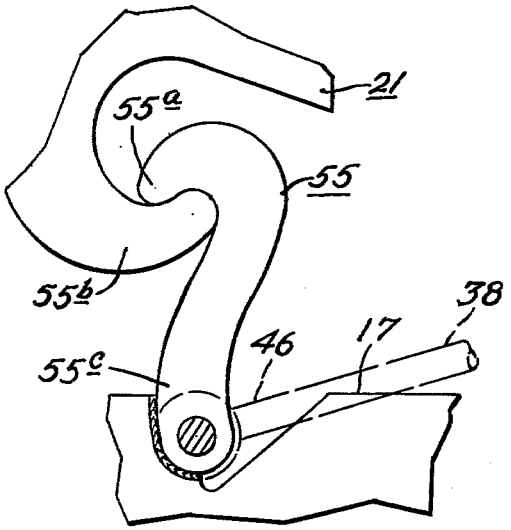
FIG. 6 is an enlarged fragmentary view of the gondola latching mechanism illustrated in FIG. 2, the view illustrating the rigid mounting of the gondola hook member to the top of the gondola.

As noted heretofore, the gondola 16 is positively latched in its uppermost retracted position, and to this end, the latching means 55 is provided. As best seen in FIG. 6, the latching means 55 comprises an upstanding hook-shaped latch member **55*a* which is rigidly secured at its lower end 55*c* to the top 17 of the gondola 16 adjacent its midsection. A hook 55*b* is provided on the bottom of the boom 21 adjacent its pivot point 22, and the hook 55*b* functions to interengage the latch member 55*a* in the manner illustrated in FIG. 2 for securing the gondola 16** in its retracted position.

The operation of the hydraulic piston and cylinder sets will now be described. The various hydraulic piston and cylinder sets are connected in a well-known manner by hydraulic hoses to an hydraulic pump mounted in the gondola 16. The pump is controlled by a switch provided in the control console 57. When the gondola 16 is in its retracted position illustrated in FIG. 2, the switch is normally off, and the pump is deactivated with the various hydraulic piston and cylinder sets locked in the positions illustrated in FIG. 2.

In order to cause the gondola 16 to descend from the retracted position illustrated in FIG. 2, the various hydraulic piston and cylinder sets are operated sequentially at various rates of speed to effect the desired unlatching of the latch mechanism 55 and the consequent descent of the gondola 16. The sequencing of hydraulic cylinders by varying their rates of extension and retraction is well known to those skilled in the art of designing hydraulic control cylinders. However, by way of further elucidation, it is noted that in the present invention, when the gondola 16 is in its retracted position, the piston and cylinder set 31 and 32 is fully retracted, while all of the other piston and cylinder sets are fully extended. To begin the descent of the gondola 16, the hydraulic pump is actuated to cause the piston and cylinder set 31 and 32 to begin to extend. Such extension causes the boom 21 to pivot about its pivot point 22 in a clockwise direction (FIG. 2) with the latching means 55 still interengaged through an included angle of 15° of boom movement. Thereafter, the piston and cylinder sets 33, 34; and 35, 36 begin to retract causing the rectangular link member 27 to pivot counterclockwise about its pivot point 29. Simultaneously, the piston and cylinder set 37, 38 begins to retract to cause the front end of the gondola 16 to pivot clockwise about its pivot point 30 at its rear end until the latching mechanism 55 disengages. Piston and cylinder sets 31, 32; 33, 34; and 35, 36 continue their respective retractions but at a faster rate to cause the gondola 16 to descend while the piston and cylinder set 37, 38 retracts at a rate which is sufficient to keep the gondola 16 nearly level through the balance of its descent.

In order to raise the gondola 16 from its fully extended position, as is illustrated in FIG. 3, the various piston and cylinder sets are sequenced and actuated at various speeds in basically a reverse of the aforementioned procedure. For instance, in the fully extended position, piston and cylinder set 31, 32 is fully extended; piston and cylinder sets 33, 34; and 35, 36 are fully retracted; and piston and cylinder set 37, 38 is partially retracted. To raise the gondola 16, the piston cylinder set 31, 32 is initially caused to retract followed by a simultaneous actuation of the piston and cylinder sets 33, 34 and 35, 36 to extend at a faster rate than the piston and cylinder set 31, 32 is retracting. Piston and cylinder set 37, 38 then extends at a rate sufficient to keep the gondola 16 in a generally horizontal position as pivot center 53 rotates about the pivot center 29. In the course of raising the gondola 16, the four piston and cylinder sets cause the gondola 16 to move rearwardly in a nearly horizontal position to about half of the distance between street level and the retracted position below the track 1. At this location, the piston and cylinder set 37, 38 retracts further to cause the front end of the gondola to tilt upward about 30° relative to the horizontal. This upward tilt of the front end of the gondola causes the fixed latch member **55*a* on the top of the gondola 16 to clear the arc of travel of the hook 55*b* on the boom 21 while continued actions of the piston and cylinder sets 31, 32 and 33, 34 and 35, 36 operate until the boom 21 is in its horizontal position. Thereafter, the piston and cylinder set 37, 38 extends fully to interengage hooks of the latching mechanism 55. After the latching mechanism 55 has been engaged, the switch on the control console 57** is turned off to deactivate the hydraulic pump.

Figure 7:
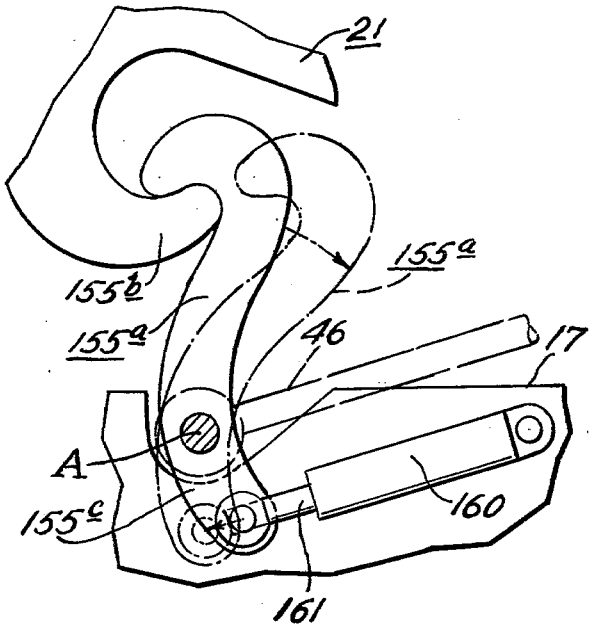
FIG. 7 is a view, similar to FIG. 6, but illustrating a modified latching mechanism.

While the upward tilting motion of the front end of the gondola 16 during latching and unlatching of the latch means **55*a* and 55*b* is not likely to be disturbing to regular passengers, there may be installations in which an entirely horizontal motion of the gondola 16 from its fully retracted position to its fully extended position is desired. In order for the gondola 16 to be maintained horizontal at all times between its fully retracted and fully extended positions, it is necessary for the hooks to engage and disengage one another with a minimal amount of pivotal motion of the boom 21 about its pivot point 22. For this purpose, as best seen in FIG. 7, a latch member 155*a* is pivotally secured to the top 17 of the gondola 16 at about its midsection to pivot about a horizontal axis A. An hydraulic cylinder and piston set 160, 161 is connected to a lower extension 155*c* of the latch member 155*a* and operates when extended and retracted to pivot the latch member 155*a* about its pivot axis A which is mounted to the gondola 16 as by a clevis. As a result, the hydraulic piston and cylinder set 160, 161 may be fully extended during the horizontal upward motion of the gondola 16 to insure clearance between the hooks until such time as the boom 21 is substantially horizontal whereupon the hydraulic cylinder and piston set 160, 161 can be retracted to cause the hooks 155*a* and 155*b* to interengage one another and effect the desired latching action. The cylinder and piston set 37, 38 may then be extended slightly to ensure positive hook contact before the hydraulic pump is turned off. Uplatching is effected by reversing this process, preferably after the cylinder and piston set 37, 38 have been retracted slightly to cause the tips of the hooks 155*a* and 155*b* to clear one another when the cylinder and piston set 160, 161 is extended. See the dotted line position in FIG. 7**.

The present invention as set forth hereinbefore has a number of advantages. First of all, by utilizing a series of relatively rigid link members and hydraulic cylinders, the gondola 16 is capable of being raised and lowered rapidly even while moving at substantial speeds. Moreover, since the boom 21 is disposed substantially parallel to the track 1 when the gondola 16 is in its retracted position, the forces of acceleration and deceleration are taken up in tension and compression of the boom 21. By virtue of the interengaged hook and latch member, the entire assembly is fail safe, since if the main hydraulic piston and cylinder set 31, 32 were to fail, the boom 21 would simply pivot about its pivot point 22 and the gondola 16 would remain safely in an elevated position above the street level. Failure of any of the other cylinders would be of no effect as long as the latching mechanism is engaged.

In view of the foregoing, it should be apparent that the present invention now provides an improved high speed monorail type vehicle which is particularly suited for use in highly congested city areas.

While a preferred embodiment of the present invention has been described in detail, various modifications, alterations and changes may be made without departing from the spirit and scope of the present invention as defined in the appended claims.

I claim:

1. Apparatus for transporting people rapidly either along a ground surface or elevated therefrom, comprising:

a monorail, a motorized carriage mounted on the monorail for movement therealong, said carriage having front and rear sets of rail engaging wheels spaced horizontally from one another, and chassis means extending along the rail to connect said front and rear sets of wheels together, a gondola disposed below said motorized carriage, said gondola having forward and aft ends and at least one wheel affording movement of the gondola along the ground, means for raising and lowering said gondola even while said carriage is in motion, including, an elongated fixed-length boom pivotally connected at one end to said chassis and having a free end, an hydraulic cylinder connected to said chassis and said boom adjacent said boom pivot connection for pivoting said boom from a retracted position disposed along the underside of said carriage to an extended position depending substantially vertically downward therefrom, and cooperating link and hydraulic cylinder means carried by the free end of said boom and operatively connected to the aft end of said gondola for raising and lowering the gondola as the boom pivots, means carried in said gondola for controlling said hydraulic cylinders, and cooperating latch means mounted atop the gondola and depending from the boom for mechanically securing the gondola in its uppermost elevated position, said latch means including a hook depending from said boom adjacent its pivot connection to said chassis and a latch member projecting upwardly from said gondola a spaced distance from the aft end of the gondola, said hook and latch member being shaped to interengage one another when the gondola is in its uppermost elevated position to restrain pivotal movement of the gondola about its aft end and to restrain said gondola from relative movement lengthwise of the boom.

2. Apparatus according to claim 1 wherein said boom is connected to said chassis adjacent the front set of wheels and said hydraulic cylinder is connected to said chassis adjacent said rear set of wheels so that the boom extends rearwardly along the underside of the carriage and the gondola extends along the underside of the boom when the gondola is in its upper limit position.

3. Apparatus according to claim 2 wherein said cooperating link and cylinder means includes a generally triangular-shaped link member mounted adjacent its vertex to the free end of the boom, a second hydraulic cylinder connecting said boom to said triangular link member above the free end of the boom, a generally rectangular-shaped link having first, second, third and fourth corners, a first one of said corners being pivotally connected to said triangular member below the free end of the boom, a third hydraulic cylinder connecting an adjacent second one of said corners to said triangular link member above the free end of the boom, means pivotally connecting the third corner to the aft end of the gondola, and a fourth hydraulic cylinder connecting said gondola to said fourth corner.

4. Apparatus according to claim 1 wherein each of said front and rear sets of wheels includes a pair of grooved wheels engaging the topside of said monorail and a grooved wheel engaging the underside of said monorail, said chassis connecting said wheels together along one side of said monorail.

5. Apparatus according to claim 1 including a rotatable turret mounted adjacent the forward end of said gondola at the top thereof to render said gondola particularly suited for police patrol work.

6. Apparatus according to claim 1 wherein said latch member is secured to the top of said gondola to pivot about a transverse axis from one position engaged with said boom hook to another position rearwardly therefrom, and including hydraulic means connecting said latch member to said gondola for effecting said pivotal motion.

* * * * *